US006554264B1

(12) United States Patent
Alford

(10) Patent No.: US 6,554,264 B1
(45) Date of Patent: Apr. 29, 2003

(54) CLAMP/SPREAD/JACK TOOL MECHANISM

(75) Inventor: Allen W. Alford, Bedford, TX (US)

(73) Assignee: Amigo Fab-Tool, Inc., Bedford, TX (US)

( * ) Notice: Subject to any disclaimer, the term of this patent is extended or adjusted under 35 U.S.C. 154(b) by 0 days.

(21) Appl. No.: 10/004,178

(22) Filed: Oct. 24, 2001

(51) Int. Cl.[7] ..... B25B 1/02
(52) U.S. Cl. ..... 269/147; 269/171; 269/279
(58) Field of Search ..... 269/147, 171, 269/166–170, 279, 148, 143, 265, 282, 283

(56) References Cited

U.S. PATENT DOCUMENTS

| | | | | |
|---|---|---|---|---|
| 307,439 A | * | 11/1884 | Corbett | 269/147 |
| 1,272,259 A | | 7/1918 | Herold | |
| 1,583,611 A | * | 5/1926 | Seely | 269/147 |
| 2,923,334 A | * | 2/1960 | Brennan, Jr. | 269/147 |
| 3,220,691 A | | 11/1965 | Dudley | |
| 4,339,113 A | | 7/1982 | Vosper | |
| 4,779,857 A | | 10/1988 | Maund | |
| 4,911,419 A | | 3/1990 | Deakin et al. | |
| 5,064,178 A | * | 11/1991 | Nimtz | 269/197 |
| 5,234,206 A | | 8/1993 | Shih | |
| 5,271,596 A | | 12/1993 | Holcomb et al. | |
| 5,338,016 A | | 8/1994 | Howard | |
| 5,356,124 A | | 10/1994 | Ai | |
| 5,443,246 A | * | 8/1995 | Peterson | 269/166 |
| 5,456,053 A | | 10/1995 | Fischer | |
| 5,964,450 A | | 10/1999 | Pasto | |

FOREIGN PATENT DOCUMENTS

DE 2458160 6/1976

* cited by examiner

*Primary Examiner*—Lee Wilson
(74) *Attorney, Agent, or Firm*—Andrews & Kurth, LLP

(57) ABSTRACT

A tool is provided for clamping, spreading and jacking activity and comprises rectangular, tubular extension bar members, which are used independently or are interconnected to establish a desired tool length. The extension bar members have a plurality of spaced positioning holes located at top bottom and sides along its length to provide length adjustments. Jaw members are selectively attached to the extension bar for force transmitting engagement with a structure or device. A power head having a tubular bar is provided with spaced shoulder members which provide support for a threaded actuator rod extending between them. A head jaw is disposed in moveable guided relation with the rectangular extension bar of the power head and is moved by a drive nut type actuator member which is in threaded relation with the threaded actuator rod and has driving engagement with the head jaw. The actuator member is selectively rotated on the threaded actuator rod by a ratcheting box end wrench for application of spreading or clamping force to the head jaw. Spreading, jacking or clamping activity is selected by selecting the position of the power head with respect to the tubular extension bar.

13 Claims, 4 Drawing Sheets

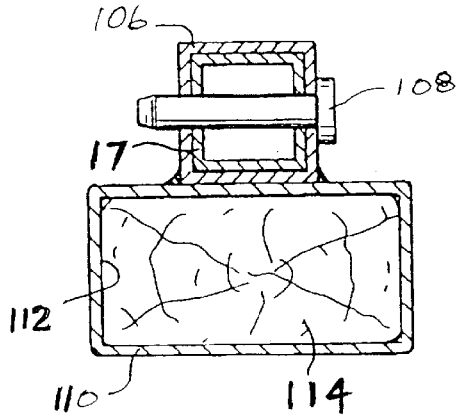
FIG. 7
FIG. 8
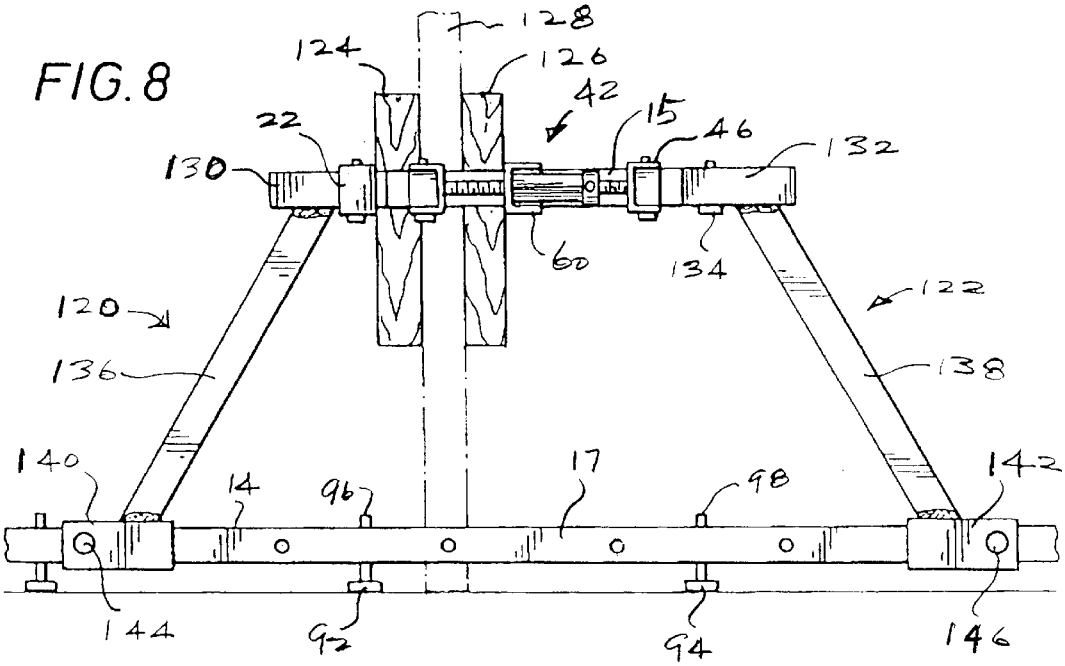
FIG. 9
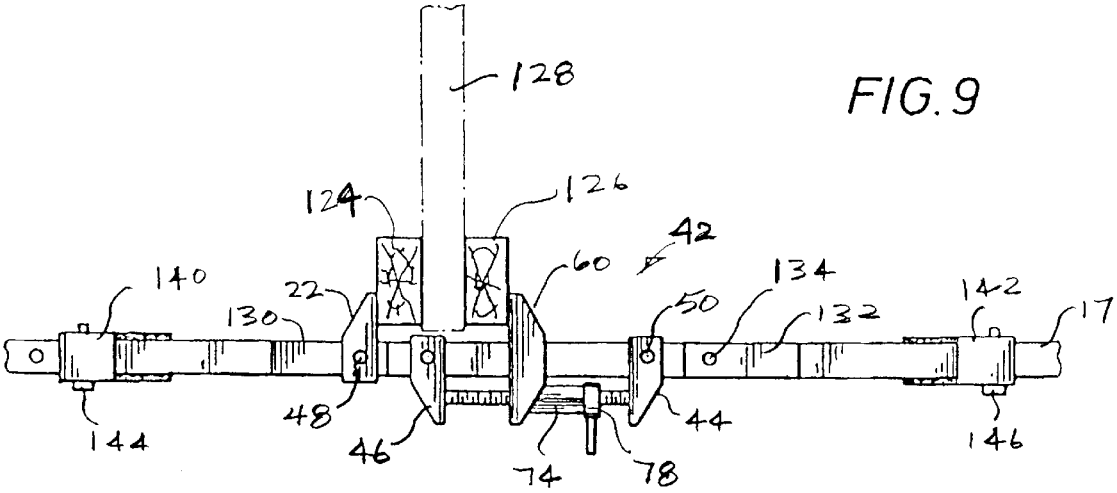

CLAMP/SPREAD/JACK TOOL MECHANISM

BACKGROUND OF THE INVENTION

1. Field of the Invention

This invention pertains generally to apparatus for applying a clamping force to members or for applying a spreading or jacking force between members. More particularly, the present invention concerns a universal tool having attachments and selectively connective and selectively positionable members, permitting the tool mechanism to be simply and efficiently adapted for applying a clamping force to various types of members, for applying a spreading force between structural members and for applying a jacking force in any suitable direction for moving one structural member relative to a fixed member or structure.

2. Description of the Prior Art

Especially to suit the needs of the construction industry, but also to facilitate many needs of the domestic environment, it is often necessary to apply clamping force to members for holding them together or to move one or both of them toward one another. Likewise, it is often desirable to apply spreading force between structural members to move at least one of them, to increase the spacing between them. Also, it is often desirable to apply a jacking force, such as between a floor or other fixed object and an elevated member, for raising or positioning the elevated member so that it may then be fixed at the selected position, connected to another structural member, etc. Typically, to accomplish clamping tasks, it is necessary to obtain one or more conventional clamps, such as the commonly known C-clamps and manually apply them to the objects to be clamped. These conventional clamp devices typically only have a clamping capability and do not have the capability for spreading or jacking. In the event a situation is encountered requiring the use of a spreading force, it then typically becomes necessary to obtain one or more spreading tools and to use them for the intended purpose. Obviously, under typical circumstances spreading tools are not capable of also providing a clamping function, to at least two different tools are generally needed if clamping and spreading activities are involved in a construction, repair or holding project.

When it becomes desirable to apply a jacking force to an object to lift it and to accurately position it for subsequent activities, typically neither clamps nor spreading tools can be used to provide an equivalent function. Thus, the well equipped construction contractor will typically also need to have available a suitable number of jacks that can be used to provide lifting functions or to provide for application of jacking force to a movable member, regardless of the direction of movement for which the jacking force is applied. The need for a number of different tools to accomplish all of the activities of construction and repair projects is expensive and cumbersome for contractors and typically causes contractors to fabricate temporary jigs and fixtures for use by workers. It is thus desirable to provide a single tool system that has the capability for simple and efficient adaptation for accomplishing clamping, spreading and jacking activities. Since the same or similar operations arise during construction or repair projects in the domestic environment, it often becomes prohibitively expensive for a homeowner to maintain an inventory of clamps, spreading tools and jacking tools for accomplishing tasks. Typically, therefore, the homeowner accomplishes such tasks with makeshift implements, often leading to dangerous practices that can lead to injury.

Although some tools have been developed which provide combined functions, such as clamping and spreading, prior to the present invention, no single tool has been available that has the capability of being utilized for selective application of clamping, spreading and jacking forces.

SUMMARY OF THE INVENTION

It is therefore a primary feature of the present invention to provide a universal tool which has the capability for being simply and efficiently adapted for clamping activity, spreading activity or for use as a jacking device or to serve as a vise for holding or positioning objects on which work is to be done.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a side elevational view having parts thereof broken away and shown in section and illustrating a jack, spread, clamp tool embodying the principles of the present invention and being employed in the clamping mode such as for forcing board members tightly together as shown in broken line;

FIG. 2 is a plan view of the jack, spread, clamp tool of FIG. 1 also being shown in the clamping mode;

FIG. 3 is a side elevational view of the jack, spread, clamp tool of FIGS. 1 and 2 being shown in the spreading mode;

FIG. 4 is an elevational view of the jack, spread, clamp tool of FIGS. 1–3 being shown in the jacking mode and having a sleeve attachment pinned thereto and having a jacking strut member such as a length of 2"×4" lumber being received by the sleeve attachment;

FIG. 5 is a sectional view being taken along line 5—5 of FIG. 1 and having parts thereof broken away and shown in section to illustrate construction details thereof;

FIG. 6 is a sectional view being taken along line 6—6 of FIG. 1 and showing one of the adjustable positioning elements of the tool in detail;

FIG. 7 is a sectional view being taken along line 7—7 of FIG. 4, illustrating the sleeve attachment of the tool in greater detail;

FIG. 8 is a side elevational view of the jack, spread, clamp tool of the present invention, showing vise leg attachments being in pinned assembly with the extension tube of the tool and showing the power head of the tool being used in the clamping or vise mode; and FIG. 9 is a plan view showing the clamping or vise mode of FIG. 8.

DETAILED DESCRIPTION OF PREFERRED EMBODIMENT

Figure 1:
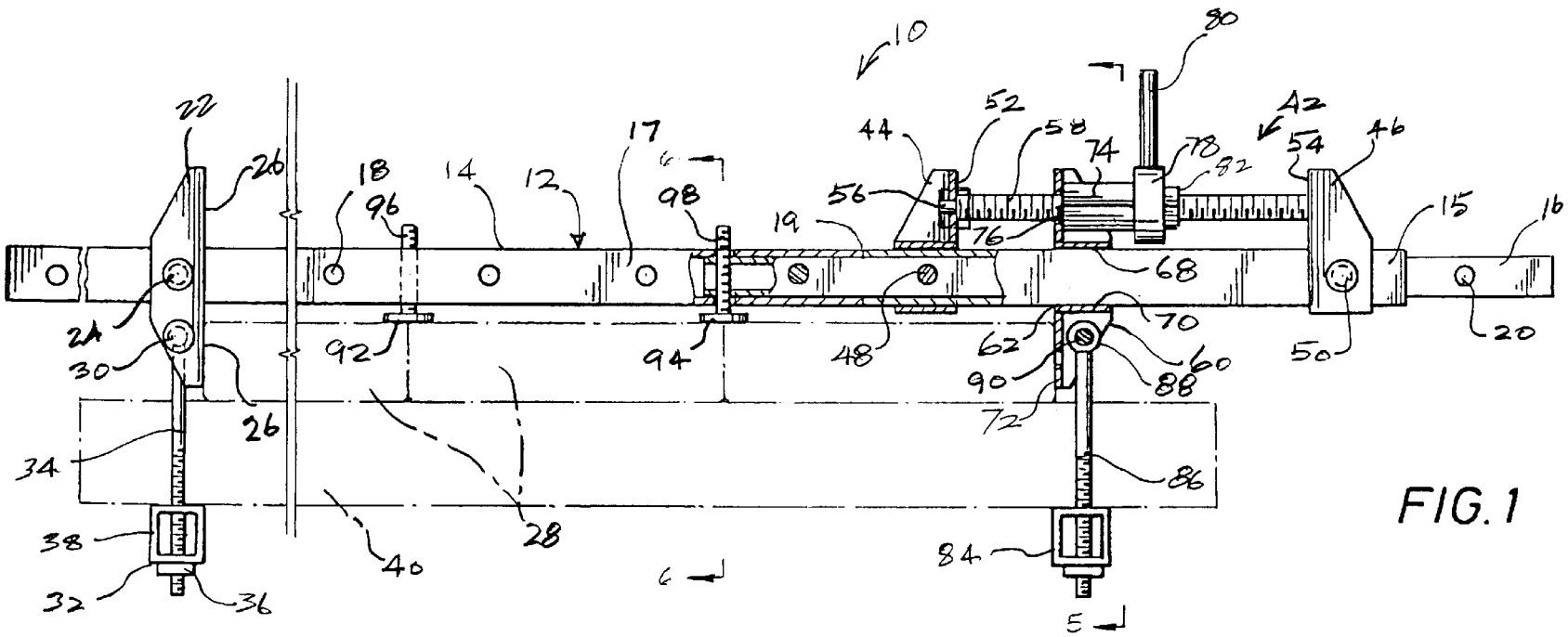
Figure 2:
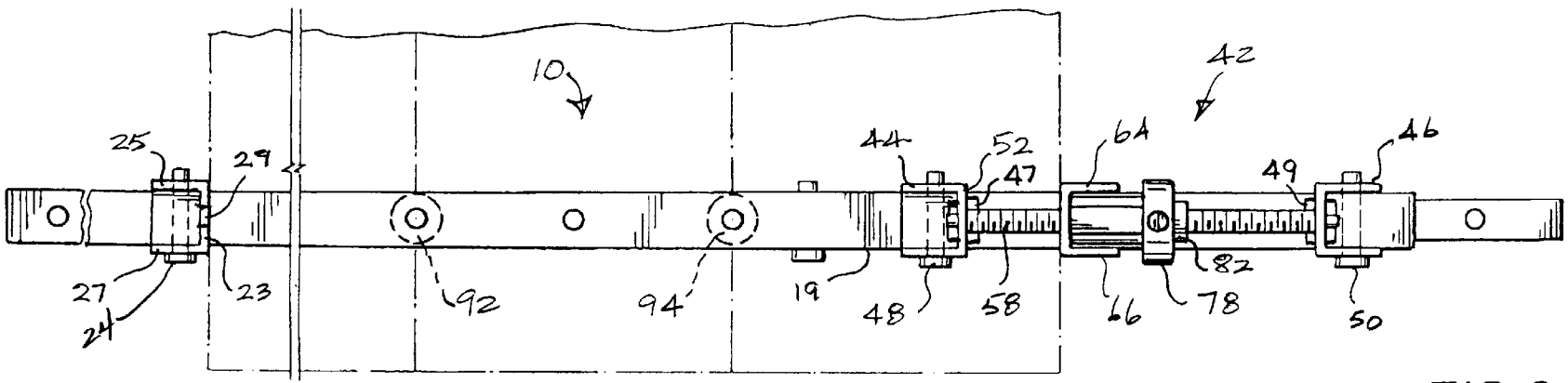

Referring now to the drawings and first to FIGS. 1 and 2, a jack, spread, clamp tool embodying the principles of the present invention is shown generally at 10. The tool 10 incorporates an extension bar, shown generally at 12 having an outer tubular element 14, typically composed of rectangular or square tubing and having an inner tubular extension element 16 which is received in telescoping relation within the outer tubular element. The outer tubular element is composed of a drive head section 15 which is disposed in end-to-end abutment with an extension section 17, defining an abutment joint at 19. The abutment joint 19 is bridged by the internal tubular element which maintains the drive head section and extension section 17 is alignment. The extension section 14 is typically provided in differing lengths, thereby permitting the operative dimension of the tool to be established in relation to the device being clamped or spread. The power head section 16 is typically provided of a single length which accommodates the head jaw movement that is desired for clamping, spreading or jacking activity. Both the outer and inner tubular elements are provided with a plurality of spaced positioning holes 18 and 20 respectively, with pairs of the positioning holes of each tubular element being in registry at differing telescoping positions of the outer tubular element and the inner tubular extension element. It should be borne in mind that the inner tubular extension element may be of solid cross-section if additional rigidity of the extension bar is needed. However, since an internal extension bar of solid cross-section would add considerable weight to the extension bar unit, it is typically desirable that the internal extension element be of tubular geometry. Typically, in the preferred embodiment of the invention, the positioning holes are provided at 6" spacing along the top and bottom and along the sides of the extension bar. The positioning holes of the top and bottom are located intermediate the positioning holes of the sides, thus providing jaw positioning spacing increments of 3" along the length of the extension bar. This feature permits the jaws to be selectively positioned in relatively close approximation of the length of the object to be clamped or spread. Obviously, the positioning holes of the inner and outer tubular bar element may be otherwise spaced as desired to suit the needs of the user. For example, metric spacing of the positioning holes may be desired.

A tail jaw attachment 22 is selectively positioned on and connected to the elongate outer tubular element 14 by a retainer pin 24 and defines a force applying shoulder structure 26 which is typically disposed for force applying contact with one or more members to be clamped, spread or otherwise moved. The structure of the tail jaw is defined in part by parallel side webs 25 and 27 which are disposed in generally parallel relation. Retainer holes are formed in the web members to receive the retainer pin 24 that secures the tail jaw in removable position of the extension bar 17 of the extension bar assembly 12. These side webs are spaced such that a portion of a 2" width of lumber, such as a 2"×4" or 2"×6" may be positioned in the space between the webs. This is an important feature which permits the tool to be used in connection with jig assemblies, thus providing the tool with additional versatility. Additionally, the wall structure of the tail jaw which defines the force applying shoulder 26 defines a hole 29 through which a nail or screw may be extended for attachment of structural members while the tail jaw is in place. Other jaw members of the tool are also provided with similar holes, so that objects being clamped or spread may be attached with nails or screws with the force transmitting jaws of the tool in clamping, spreading or jacking position. The position of the tail jaw can be reversed from the FIG. 1 position in the event it is to be used for application or a pushing force, such as during spreading or jacking activities or when the tool is used for applying force to a jig to which the tool is assembled or operatively connected. Also, the tail jaw can be positioned at a 90° offset position from that shown in FIG. 1, and may be oriented for the clamping or spreading mode as desired.

As shown in FIGS. 1 and 2 in broken line, members such as boards 28 are being clamped by the apparatus. The U-shaped cross-sectional configuration of the tail jaw, and the spacing of the web members 25 and 27, as shown in FIG. 2, permit a clamp, such as a C-clamp, to be applied to the tail jaw as needed to secure it with respect to another member. A conventional C-clamp is positionable with one of its force applying members located between the webs 25 and 27 and in force applying engagement with the transverse wall structure 23 with which the webs are integral. The tail jaw attachment 22, in addition to being provided with opposed holes to receive the retainer pin 24, is also provided with an additional pair of opposed, registering holes for receiving a second retainer pin 30 for connection of a hold-down attachment 32 thereto. The hold-down attachment includes a pair of hold-down rods 34 having upper ends defining openings through which the retainer pin extends and having lower threaded ends receiving retainer nuts 36. The retainer nuts secure a hold-down foot member 38, which is a transversely located bar having through which the hold-down rods extend. The hold-down foot member is positioned beneath a structural element, such as is shown in broken line at 40 in FIG. 1 and serves to restrain the tail jaw attachment 22 from moving upwardly with respect to the boards 28 and the structural member 40. Obviously, the hold-down member can serve to engage any other suitable structural member to prevent the respective jaw attachments and thus the extension bar assembly from moving upwardly from the FIG. 1 position when clamping force is applied by the movable jaw to the boards or other objects 28.

The extension bar assembly 12 is also provided with a power head assembly shown generally at 42 and which enables application of clamping, spreading or jacking force, depending upon the arrangement of the various components of the tool. The power head assembly 42 has a pair of shoulder brackets 44 and 46 which are disposed in spaced relation as shown in FIG. 1 and are each positioned with opposed holes thereof disposed in registry with respective spaced holes of the outer tubular element 14 and the inner tubular extension element 16. Retainer pins 48 and 50 extend through these registering locator holes and thus serve to retain the shoulder brackets in substantially fixed relation with respect to the outer tubular element 14 and the inner tubular extension element 16. The shoulder brackets 44 and 46 each define structural walls 52 and 54 which define apertures receiving respective support pin extensions 56 of a threaded actuator rod 58. The threaded actuator rod is secured against rotation relative to the shoulder brackets 44 and 46 such as by means of lock nuts 47 and 49.

A movable head jaw 60 defines a rectangular opening 62 receiving the rectangular outer tubular member 14 and permitting relative movement of the head jaw with respect to the outer tubular member. The rectangular opening 62 of the head jaw 60 is defined by side webs 64 and 66, which provide the head jaw 60 with a generally U-shaped configuration when viewed in plan, as shown in FIG. 2. The rectangular opening is also defined in part by transverse guide flanges 68 and 70 which are disposed in substantially parallel relation and thus cause the head jaw to maintain the orientation shown in FIG. 1 during its linear movement. This feature causes a force applying wall structure 72 to be maintained in substantially perpendicular relation with the outer tubular extension element 16 during force applying movement of the head jaw, regardless whether the force being applied by the head jaw is a clamping force, a spreading force or a jacking force.

The head jaw 60 is moved linearly by a rotary actuator 74 which defines an internal threaded section receiving the external threads of the threaded actuator rod. The rotary actuator 74 is thus an elongate nut member having a drive extremity 76 which is disposed in force transmitting engagement with the force applying wall structure 72 of the head jaw. The rotary actuator is moved linearly by its rotation relative to the rotary actuator rod. A ratcheting box end wrench 78 having a wrench handle 80 is positioned with its box drive in driving relation with the drive end section 82 of the rotary actuator 74. The wrench handle is reciprocated arcuately for imparting driving rotation to the drive end section 82 of the rotary actuator.

Figure 6:
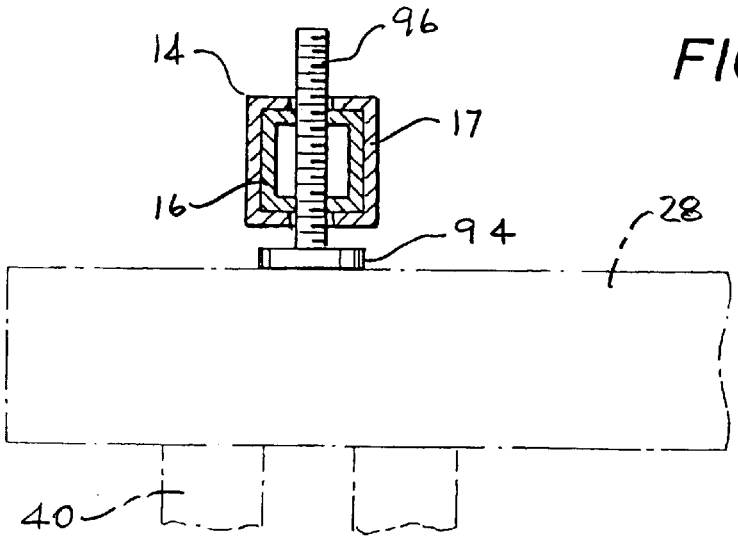

Like the tail jaw attachment 22, it is desirable to ensure that the tool remains stabilized in relation to the work piece that is being clamped or spread. This feature is accomplished by a hold-down foot 84 which is typically positioned transversely beneath a structural element 40 as shown in FIG. 1. A pair of hold-down rods 86 define retainer eyes 88 at the upper ends thereof which receive a retainer pin 90 which extends through registering apertures in the side webs 64 and 66 of the head jaw 60. Retainer nut elements 87 are received by threaded ends 89 of the hold-down rods and thus retain the hold-down foot in position or bind the hold-down element in its retaining position relative to the work-piece and a structural element. As force is being applied by the power head assembly 42 any tendency of the work-piece to move transversely is restrained by the hold-down assemblies of the tail jaw and head jaw. Positioning of the tool with respect to the work-piece is also ensured by adjustable foot elements 92 and 94 which have threaded shafts 96 and 98 that are adjustably received by internally threaded openings of the inner and outer tubular elements. The adjustable foot elements are spaced such that they typically engage the work-piece at suitable holding locations to thus prevent the boards or other structures being clamped from becoming misaligned relative to the extension bar assembly. Typically, the adjustable foot elements each have a soft, non scuff pad that ensures against scratching, denting or otherwise marring the surface finish of an object being clamped. With reference to the sectional view of FIG. 6, it should be noted that the threaded shaft 96 of the adjustable foot element extends through registering threaded apertures of the inner tubular element 16 and through larger openings of the outer tubular extension bar element 17 as shown. Additionally, one or more of the adjustable foot elements may also serve for retention of the inner and outer tubular bar elements as shown in FIG. 1, so that the extension section 17 of the extension bar assembly 14 is secured in abutting relation with bar section of the power head.

Figure 3:
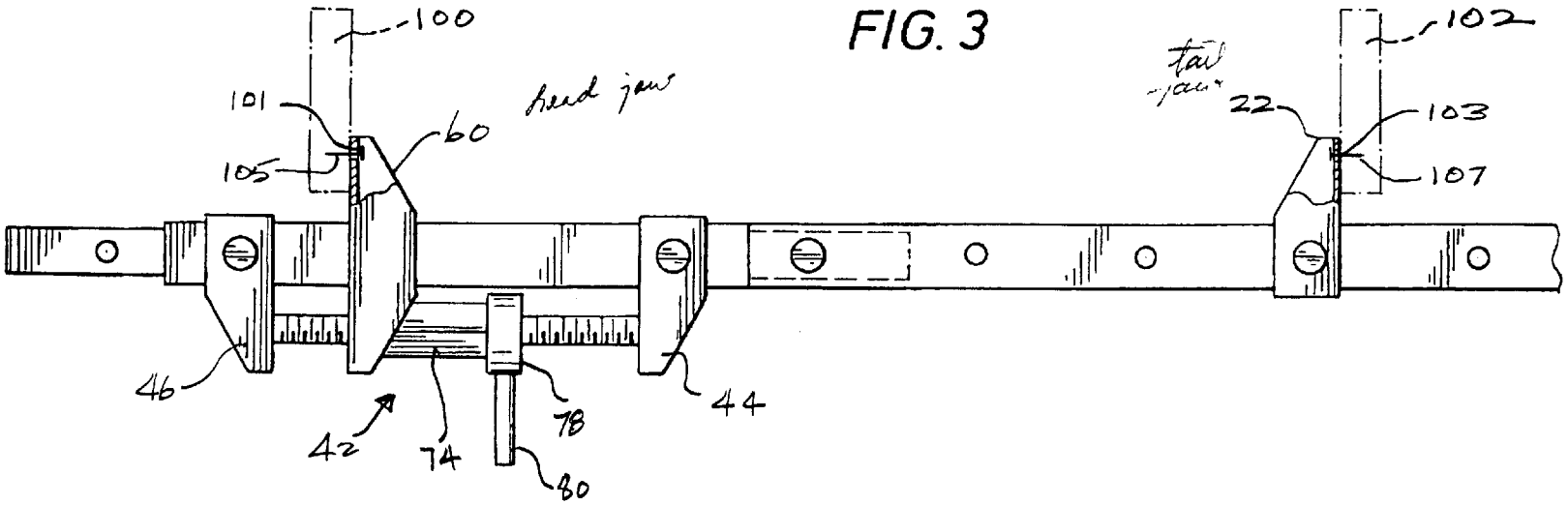

Referring now to FIG. 3, the tool of FIGS. 1 and 2 is shown in its spreading mode and is arranged for application of spreading force to members 100 and 102. In this case, the head jaw 60 is reversed with respect to the tail jaw 22, so that the head jaw is moved by the actuating mechanism of the power head 42 in a direction away from the tail jaw. Also in this case, the power head is reversed, end wise, from its clamping mode position of FIGS. 1 and 2 so that the extension bar member extends from the spread end of the power head. When application of spreading force is applied in this manner, the jail jaw 22 is positioned in force transmitting engagement with the member 102 and the head jaw is positioned in force transmitting engagement with the member 100. The ratcheting box end wrench is then actuated in a direction for moving the head jaw away from the tail jaw 22, thus applying spreading force to the members 100 and 102, so as to move the members apart. This feature is often needed when floor and ceiling joists are to be accurately spaced and must be forcibly moved. Such spreading force, as well as clamping force, is often needed in a wide variety of situations in the construction industry. Thus, it is desirable to have a single force applying tool mechanism that is efficiently useable in both clamping and spreading situations.

In situations where the tool is to be supported beneath joist members 100 and 102, as shown in FIG. 3, retainer openings 101 and 103 in the head jaw 60 and tail jaw 22, respectively, receive nails, screws or other retainers 105 and 107 so that the respective jaw members can be temporarily attached to the joist members. These temporary retainers secure the tool in place with respect to the joists until such time as the ratcheting box end wrench is actuated for application of spreading force to the joists. In similar fashion, temporary retainers may be used to stabilize or position the tool prior to application of a clamping force to objects which are to be held together or moved toward one another. As mentioned above in connection with FIG. 2, the head and tail jaws may be provided with openings in the transverse wall structure thereof, so that screws or nails may be driven into objects being clamped or spread, with the jaws being maintained in clamping or spreading engagement with structural members. This feature is especially important when twisted or bent lumber pieces must be forced to a desired position and held, to permit nailing or screwing to be accomplished to secure them in assembly.

Figure 4:
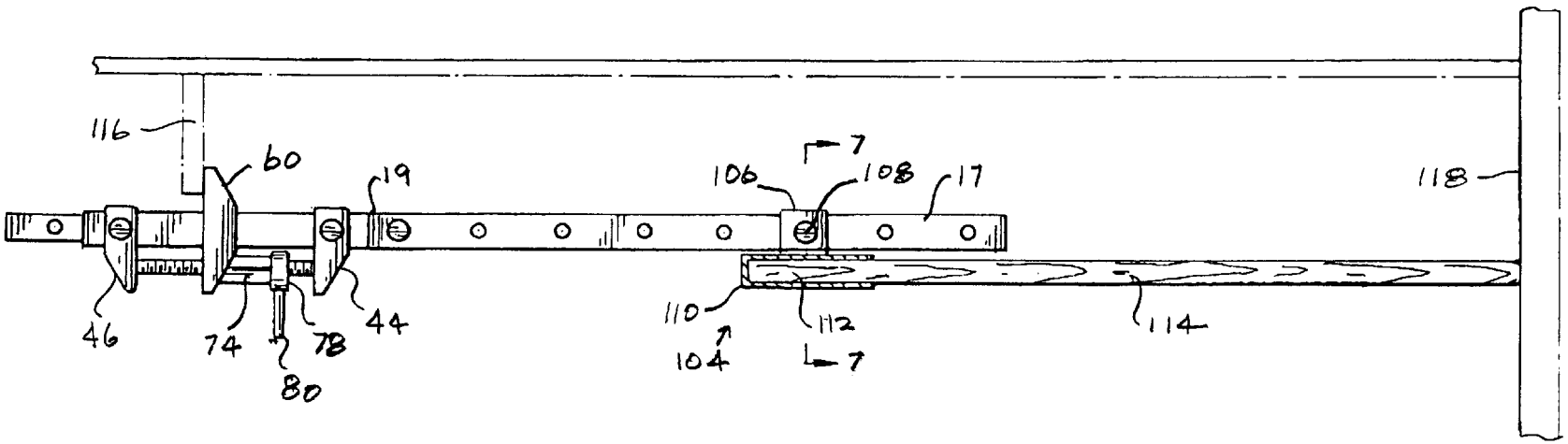
Figure 5:
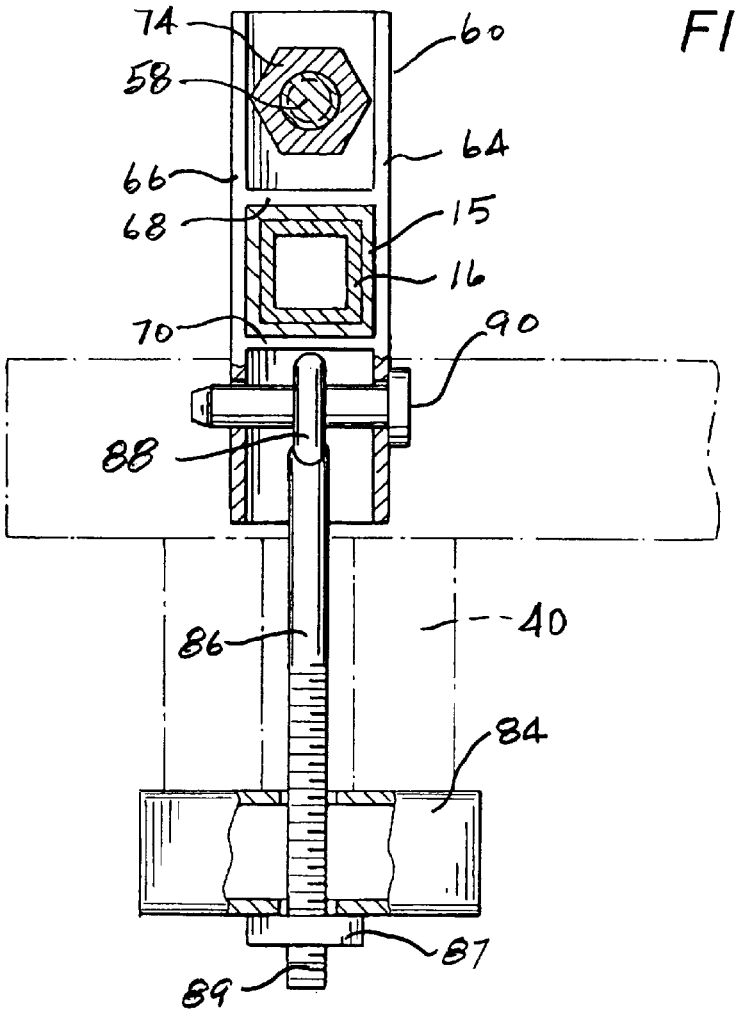

As shown in FIG. 4, the same general force applying tool mechanism of FIGS. 1–3 is also efficiently useable for jacking, such as when an object needs to be moved vertically, as is typical, or in any other direction. Instead of using the tail jaw 22, a spread-jack sleeve fitting shown generally at 104 and includes a positioning sleeve member 106 which defines a rectangular opening receiving the outer tubular extension section 17 of the extension bar assembly 14. The positioning sleeve member 106 defines opposed registering apertures which receive a retainer pin 198 which also extends through registering apertures of the outer tubular extension section 17. The positioning sleeve member 106 is thus adjustably positionable at any selected location along the length of the outer tubular extension section 17 simply by aligning the respective apertures of the positioning sleeve member and the outer tubular extension section 17 and by inserting the retainer pin 108 into the aligned apertures. An extension receptacle 110 is fixed to the positioning sleeve member 106 and defines an internal receptacle or pocket 112 of a dimension and cross-sectional configuration for receiving an extension member 114. As show in FIG. 4, the extension member 114 is defined by a length of 2"×4" lumber which is cut to a suitable length for the intended jacking operation. It should be borne in mind that the extension member 114 and the internal receptacle 112 may have any other suitable cross-sectional configuration, thus permitting other types of extension members to be utilized within the spirit and scope of the present invention. In this case, the receptacle pocket will be of rectangular configuration closely approximating the dimension of the lumber that composes the extension member. With the tool and the extension member 114 positioned as shown in FIG. 4, manipulation of the rotary actuator by manual operation of the ratcheting box end wrench mechanism will cause the head jaw 60 to be moved toward an extension member 116 to which jacking force is to be applied. When this occurs, the free end of the extension member 114 will react against the structure 118, causing the extension member 116 and structure 118 to be moved apart. When the structure 118 is the floor of a building, the member 116 can be elevated to any suitable position and then can be fixed, such as by nailing, bolting, etc. to any other structure. After the jacking operation has been completed, the lumber piece that has been utilized as the extension member may be removed from the receptacle and utilized in the construction project. Thus, jacking of considerable height may be efficiently accomplished, without necessitating the provision of a jack device having an extension member of sufficient length to accommodate the space between objects.

In many cases, during construction operations, as well as during other circumstances, it is desirable to utilize a vise that is designed for clamping or supporting narrow objects, such as doors, so that work, such as attachment of hinge fittings, door hardware, locks and the like, can be efficiently done. The tool of the present invention is readily adaptable to this purpose, as shown in FIGS. 8 and 9. A pair of vise leg fittings shown generally at 120 and 122 are adapted for assembly with the outer tubular extension element 14 or its extension section 17 and for assembly with the tubular bar section 15 of the power head assembly 42 as shown. With the power head assembly 42 arranged with its tail jaw 22 and head jaw 60 situated for clamping activity, members 124 and 126 may be positioned on either side of a door 128, thus permitting the door to be clamped while positioned on its edge, without damaging the door. With the inner tubular element 16 positioned within the outer tubular section 15 and with end sections of the inner tubular element projecting beyond respective ends of the outer tubular section, tubular elements 130 and 132 of the respective vise leg fittings 120 and 122 are assembled over the extensions of the inner tubular element and are secured thereto by retainer pins 134. From the tubular elements 130 and 132 extend angular leg members 136 and 138 that are attached to the tubular elements such as by welding. Tubular elements 140 and 142 are received by the tubular extension member 14 or 17 as the case may be, and are also fixed by welding or any other suitable means of attachment to the angular leg members 136 and 138. Retainer pins 144 and 146 extend through registering apertures in the tubular extension member and the tubular elements 140 and 142 and serve to releasably secure the vise fittings to the tubular extension member. In the same manner as explained above the power head 42 is actuated by manually actuation of the ratcheting box end wrench 78, thus causing the head jaw to be moved toward the tail jaw for clamping of the door or other such object. In the case of doors, when held by the vise arrangement, the door may be easily be mortised for hinges and other fittings, may be planed or sanded. The vise leg fittings 120 and 122 permit the clamping force of the door vise arrangement of FIGS. 8 and 9 to be applied away from the edge of the object being clamped, whether it be a door or some other object that is supported in the same manner.

Thus, it is evident from the foregoing explanation that the tool of the present invention may be simply and efficiently adapted for clamping, spreading or for application of jacking force, without necessitating the provision of separate tool for each purpose. To suite a variety of clamping and spreading functions and to provide the tool with versatility of use, the tubular extension bars that make up the length of the tool are provided in differing lengths. In one form of the invention, the longest extension bar has a length of 48", another is 36" in length and the bar of the power head has a length of 16". By assembling the extension bars to the ends of the power head bar a maximum tool length of 100" is defined. Yet the tool can be efficiently stored in a box that is sufficiently short to be carried in the trunk of a conventional automobile. The tool is also designed to accomplish both clamping and spreading functions within a blind pocket, functions that cannot be accomplished by conventional clamps and spreading tools. This feature is accomplished by rotated positioning of the jaws for perpendicular relation with the power head, so that the ratcheting wrench of he power head can be easily actuated for spreading or clamping, depending upon selective orientation of the power head in the clamping or spreading mode.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A tool for clamping, spreading and jacking activity, comprising:

a power head tubing section having first and second ends;

a pair power head shoulder members being provided on said power head tubing section;

a threaded actuator rod being supported by said power head shoulder members and being in substantially parallel and spaced relation with said power head tubing section;

a head jaw member being disposed in linearly moveable guided relation with said power head tubing section and said threaded actuator rod; and an actuator member being in threaded relation with said threaded actuator rod and having driving relation with said head jaw member, said actuator member moving linearly upon selective rotation thereof on said threaded actuator rod and imparting linear movement to said head jaw member for clamping or spreading movement of said head jaw member;

a tubular extension bar member being selectively connected in end-to-end relation with said power head tubing section and having a plurality of spaced positioning holes located along the length thereof;

a tail jaw member being positioned at a suitable location along the length of said extension bar member and being selectively oriented for application of clamping or spreading force to an object; and said tubular extension bar member being connected to said first end of said power head tubing section for clamping activity and being connected to said second end of said power head tubing section for spreading and jacking activity.

2. The tool of claim 1, comprising:

an inner bar member being positioned within said power head tubing section and having at least one end thereof extending beyond at least one of said first and second ends of said power head tubing section, said inner bar member having at least one retainer hole therein for registry with a retainer hole of said tubular extension member; and a retainer pin being releasably received within said retainer holes of said tubular extension bar member and said inner bar member for reseasably securing said tubular extension bar member to said inner bar member and in end to end relation with said power head tubing section.

3. The tool of claim 1, comprising:

said power head tubing section, said an inner bar member and said tubular extension bar member being of rectangular cross-sectional configuration and said tubular extension bar member being of substantially the same internal cross-sectional dimension as said power head tubing section.

4. The tool of claim 1, comprising:

said head jaw and tail jaw members each being of a configuration for engagement by a clamp in the event clamping thereof to other members is desired.

5. The tool of claim 1, comprising:

said head jaw and tail jaw members each having a force transmitting wall for clamping or spreading force transmitting contact with objects, said force transmitting wall being arranged for contact by clamp members for clamping thereof to other members as desired.

6. The tool of claim 5, comprising:

said force transmitting walls each defining connector access openings to permit connectors to be extended therethrough for fixing objects together while said head jaw and tail jaw members remain in force transmitting contact with the objects being clamped or spread.

7. The tool of claim 1, comprising:

a plurality of adjustable foot elements being connected to said tubular extension bar member and being positioned for contact with objects being clamped, each of said adjustable foot elements having a threaded shaft being adjustably receivable by said tubular extension bar member and having a foot element preventing scuffing of an object being clamped.

8. The tool of claim 1, comprising:

hold-down members being connected to said head jaw member and said tail jaw member and having hold-down rods supporting a hold-down foot for positioning beneath a structural element and preventing rising of said universal tool relative to the structural element and the object being clamped as clamping force is applied to an object by said head jaw member and said tail jaw member.

9. The tool of claim 1, comprising:

an inner bar member being positioned within said power head tubing section and having ends thereof extending beyond said first and second ends of said power head tubing section;

a pair of vise legs each having first and second tubular connectors interconnected by leg members, said first tubular connectors of said pair of vise legs being received by said ends of said inner bar member and said second tubular connectors of said pair of vise legs being received by said tubular extension bar member and aligned with positioning holes thereof; and retainer pins releasably securing said tubular connectors of said pair of vise legs to said inner bar member and said tubular extension bar member.

10. The tool of claim 1, comprising:

said tubular extension bar member being of rectangular cross-sectional configuration, defining top and bottom walls and side walls; and said positioning holes being equally spaced positioning holes along said top and bottom walls and along said side walls, said positioning holes of said side walls being located intermediate said positioning holes of said top and bottom walls and cooperating with said positioning holes of said top and bottom walls to define increments of spacing less than the spacing of said positioning holes of said top and bottom walls and said positioning holes of said side walls.

11. The tool of claim 1, comprising:

said tail jaw defining a non-circular opening of a configuration matching the outer non-circular configuration of said tubular extension bar member and being positionable at a 90° offset positions on said tubular extension bar member, said tail jaw also being selectively reversable on said tubular extension bar member to provide for clamping or spreading action..

12. The tool of claim 1, comprising:

a spread-jack fitting being receivable on said tubular extension bar member and defining an extension receptacle; and a jack extension member of desired length having an end thereof received within said extension receptacle and cooperating with said power head and said tubular extension bar member to form jack device which is positioned substantially vertically for lifting and positioned at any suitable orientation for spreading.

13. The tool of claim 12, said spread-jack fitting comprising:

a positioning sleeve being receivable on said tubular extension bar member and defining a retainer opening for receiving a retainer pin for securing said positioning sleeve on said tubular extension bar member;

an extension receptacle being fixed to said positioning sleeve and defining a receptacle pocket; and said jack extension member being receivable within said receptacle pocket and having a cross-sectional configuration and dimension corresponding to the cross-sectional configuration and dimension of said receptacle pocket.

* * * * *